United States Patent [19]

Yamada

[11] Patent Number: 4,759,198

[45] Date of Patent: Jul. 26, 1988

[54] VENTILATOR FOR REFRIGERATOR

[75] Inventor: Kenichi Yamada, Yokohama, Japan

[73] Assignee: Takigen Manufacturing Co. Ltd., Tokyo, Japan

[21] Appl. No.: 96,229

[22] Filed: Sep. 8, 1987

Related U.S. Application Data

[63] Continuation of Ser. No. 927,739, Nov. 5, 1986, abandoned.

[30] Foreign Application Priority Data

Nov. 6, 1985 [JP] Japan ..... 60-170519

[51] Int. Cl.[4] ..... F25D 17/04

[52] U.S. Cl. ..... 62/409; 137/269.5; 137/341; 137/527.8

[58] Field of Search ..... 62/409, 410, 412; 98/119; 137/269.5, 270, 341, 360, 527.8

[56] References Cited

U.S. PATENT DOCUMENTS

| | | | |
|---|---|---|---|
| 793,577 | 6/1905 | Frank | 137/269.5 X |
| 2,589,176 | 3/1952 | Wheatley | 137/269.5 |
| 3,565,099 | 2/1971 | Huber | 137/269.5 |
| 3,952,542 | 4/1976 | Berkowitz | 62/409 |
| 4,257,445 | 3/1981 | Cook et al. | 137/360 X |
| 4,296,772 | 10/1981 | Nilsson | 137/269.5 |
| 4,499,917 | 2/1985 | Fujiya | 137/341 |

*Primary Examiner*—William E. Tapolcai
*Attorney, Agent, or Firm*—Martin Smolowitz

[57] ABSTRACT

A ventilator for a refrigerator which comprises a first frame inserted into a ventilation hole provided in a wall panel of a refrigerator, a second frame inserted into the ventilation hole from the outside of the refrigerator, and a mounting base provided with a valve plate and a valve body. The first and second frames are coupled together with their respective extension portions fitted together. The orientation of mounting of the mounting base in the first frame is varied for using the ventilator either for discharge or for intake of air.

7 Claims, 4 Drawing Sheets

VENTILATOR FOR REFRIGERATOR

This application is a continuation of application Ser. No. 927,739 filed Nov. 5, 1986 now abandoned.

BACKGROUND OF THE INVENTION

1. Field of the Invention

The invention relates to a ventilator for a refrigerator, which automatically adjusts air pressure in a large size refrigerator, a freezer, etc. with the opening and closing of a valve plate for the air pressure adjustment.

2. Prior Art

U.S. Pat. No. 3,952,542 discloses a prior art ventilator for a freezer or the like, which has such a construction that it provides a function of reducing air pressure in the freezer by discharging air therefrom at the time when the freezer pressure is increased and has a function of increasing air pressure in the freezer by introducing air from the outside at the time when the freezer air pressure is reduced.

With such ventilator for a freezer or the like, the two functions of discharging and introducing air are provided by a single ventilator. Therefore, the internal construction of the ventilator is undesirably complicated.

SUMMARY OF THE INVENTION

An object of the invention is to provide a ventilator for a freezer, a refrigerator or the like, which has a simplified construction and can be used either for the discharge or the intake of air without need of preparing two different sets of internal components for the ventilator.

According to the invention, there is provided a ventilator for a refrigerator, which comprises a first frame inserted into a ventilation hole provided in a wall panel of a refrigerator, a seccond frame inserted into the ventilation hole from the outside of the refrigerator, and a mounting base provided with a valve plate and a valve body, the first and second frames being coupled together with their respective extension portions fitted together, the orientation of mounting of the mounting base in the first frame being varied for using the ventilator either for discharge or for intake of ventilation air.

BRIEF DESCRIPTION OF THE DRAWINGS

The drawings illustrate an embodiment of the ventilator according to the invention, in which.

DETAILED DESCRIPTION OF THE PREFERRED EMBODIMENT

Figure 1:
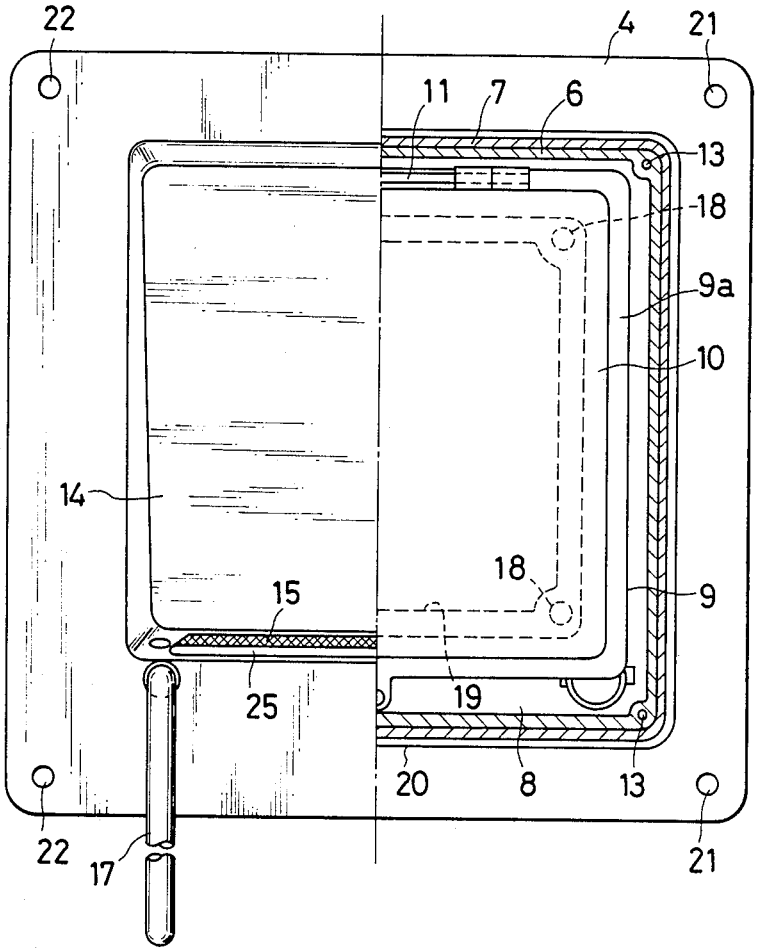
FIG. 1 is a back view, with the right half shown in section, showing a ventilator assembled for discharge of ventilation.

Referring to the Figures, an embodiment of the ventilator for a refrigerator according to the invention includes a first frame 4, which is inserted into a ventilation hole 3 provided in a wall panel 2 of the refrigerator 1 from the inside of the refrigerator, a second frame 5 inserted into a ventilation hole 3 from the outside of the refrigerator 1 and a mounting base plate 6 with a valve plate 10 and valve body 9 removably mounted on the first frame 4. The first and second frames 4 and 5 are coupled together by fitting together their cylindrical or rectangular shaped extension portions 6 and 7 so that extension portion 7 slides over and at least partially encloses extension portion 6.

The orientation, in which the mounting base 8 is mounted on the first frame 4, is varied for using the ventilator either for intake or discharge of air.

Figure 3:
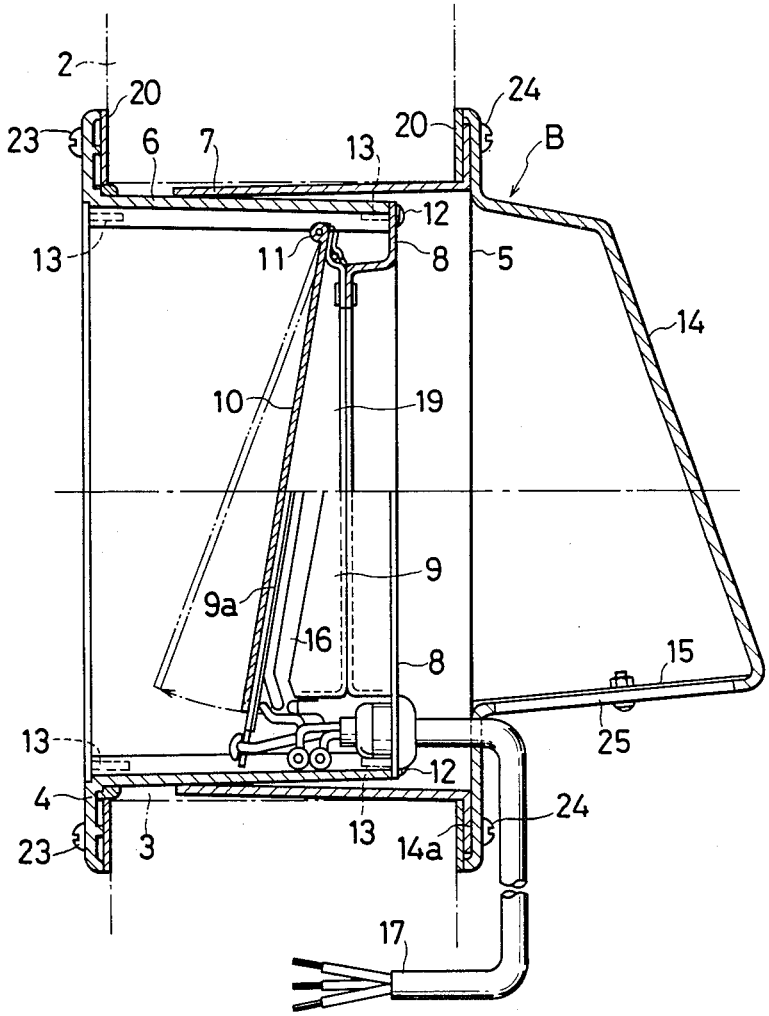
FIG. 3 is a fragmentary vertical sectional view showing a ventilator adopted for use for intake.

The valve plate 10 provided in the pivotable ventilator cuts off flow of air between the inside and outside of the refrigerator 1 when it closes a valve seat **9*a* by its own weight. When the temperature of air in the refrigerator is reduced, the air pressure therein is also reduced. The valve plate 10 thus experiences a force tending to urge it inwards due to the greater outside atmospheric pressure. At this time, in the case of intake ventilator B having a construction in which the valve plate 10 is open only to the inner side, the valve plate 10 is held in an open state, as is shown by FIG. 3. When the air pressure inside the refrigerator and the air pressure outside the refrigerator become equal, the pivotable valve plate 10 is closed against valve seat 9*a*** due to its own weight.

When the temperature of air in the refrigerator is elevated due to defrosting or like cause, the air pressure in the refrigerator is increased, so that the valve plate 10 experiences a force tending to urge it outwards due to the inside air. At this time, in the case of a discharge ventilator A, in which the valve plate 10 is opened only to the outside, the valve plate 10 is opened as shown by FIG. 2, and it is closed against seat **9*a*** due to its own weight when the air pressure inside and that outside the refrigerator become equal.

In the illustrated embodiment, first frame 4 is inserted into ventilation hole or port 3 provided in wall panel 2 of a large size refrigerator 1, and the second frame 5 is inserted from the outside of the refrigerator. Cylindrical or rectangular shaped extension portions 6 and 7 of the first and second frames 4 and 5 are fitted together in correspondence to the thickness of the panel 2. The outer edges of the frames 4 and 5 are secured to the edges of the ventilation hole 3 via a packing or gasket 20, whereby the frames 4 and 5 are coupled together.

The first frame 4 is secured to the wall panel 2 by bolts 23 inserted through holes 21 formed at four corners of the first frame 4. The first frame 4 has threaded holes 13 located at side positions facing inner and outer sides of the refrigerator. The mounting plate 8 is secured to first frame 4 at either its inner or outer side by bolts 12 screwed through these threaded holes 13. The second frame 5 is fitted in an inner stepped portion **14*a* of a refrigerator cover 14. When the refrigerator cover 14 is secured to the wall panel 2 by the bolts 24 passing through four corner holes 22 of the refrigerator cover 14, a flange of the second frame 5 is urged and fastened against the wall panel 2. The refrigerator cover 14 has a box-like shape, and it has an opening 25 formed in the cover lower surface. An anti-insect screen 15 is intalled in the opening 25. A cord 17 extends from the cover 14 along the inner lower wall of the extension portions 6 and 7 to be connected to a frosting prevention heater 16**.

Figure 2:
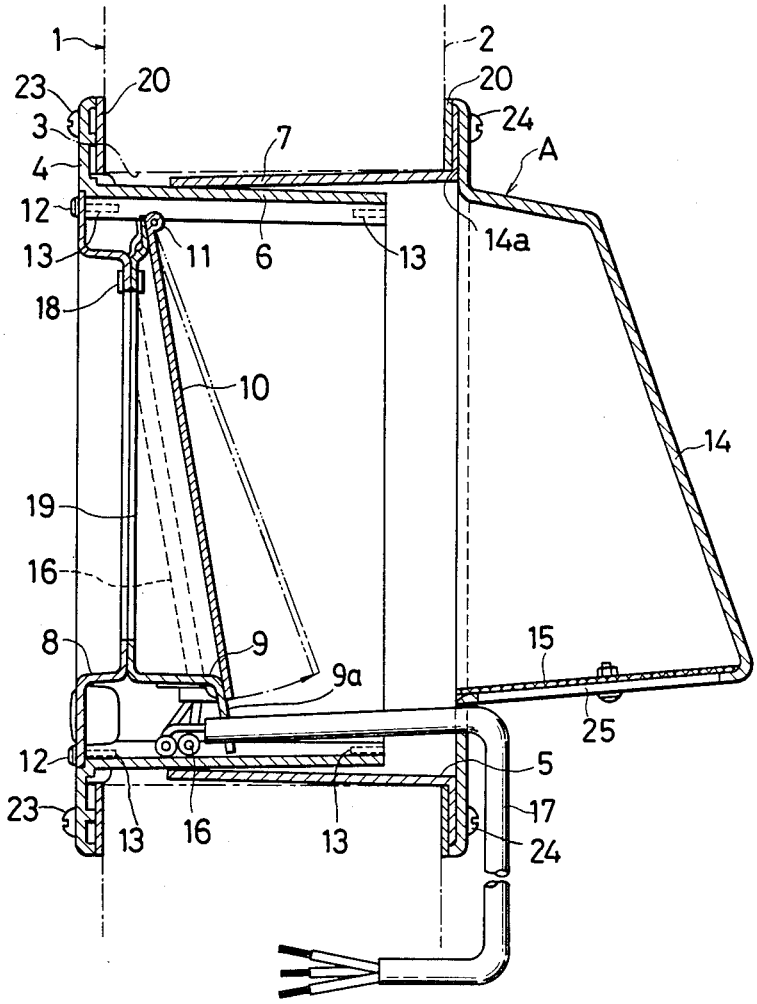
FIG. 2 is a vertical sectional view showing a ventilator adapted for use for discharge.

In the ventilator shown in FIG. 2, the mounting plate 8 is secured by the bolts 12 screwed in the inner side threaded holes 13 of the first frame 4, such that all the components including the valve plate 10 and valve body 9 are accommodated in the cylindrical extension portion 6 of the first frame. The valve body 9 is secured by bolts 18 to the mounting plate 8. The valve plate 10 is rotatably mounted by a horizontal shaft 11 on the valve body 9 having an inclined seat surface 9*a*. The closure position of the valve opening 19 by the valve plate 10 is determined by the inclination angle of the valve body 9. Due to the presence of the valve body 9, the valve plate 10 is opened only to the outer side of the refrigerator, therefore this ventilator is used for the discharge of refrigerator ventilation air.

In the ventilator shown FIG. 3, like the ventilator shown in FIG. 2, the mounting plate 8 is mounted on the first frame 4 using outer side threaded holes 13 thereof. More particularly, the positional relation of the inner components is just symmetrical to that shown in FIG. 2. The valve plate 10 is thus restricted by the valve body 9 such that it is opened only to the inside of the refrigerator. Therefore, this ventilator is used for intake of refrigerator air.

Figure 4:
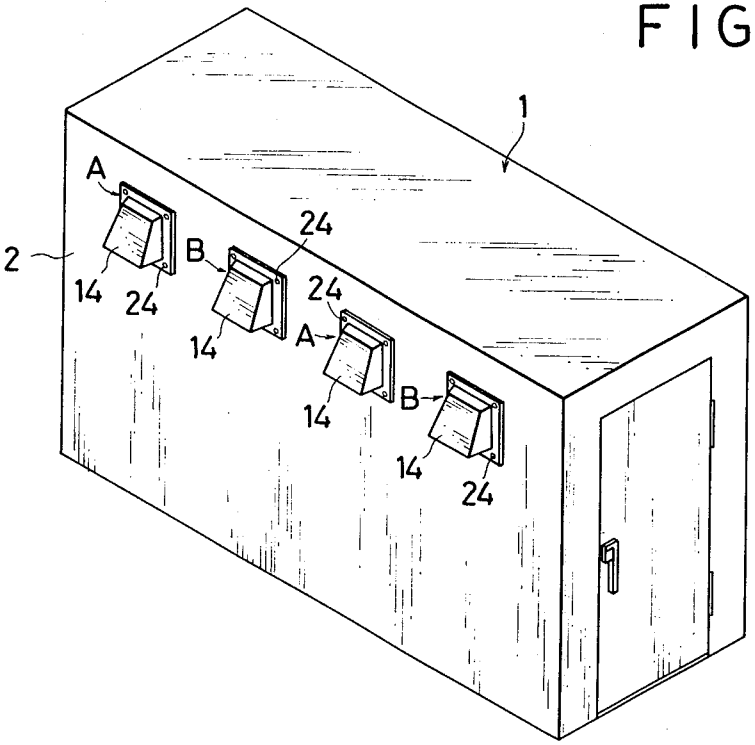
FIG. 4 is a perspective view showing a large size refrigerator comprising ventilators arranged for discharge and intake, respectively of ventilation air.

In the embodiment shown in FIG. 4, wall panel 2 of large size refrigerator 1 is provided with a plurality of ventilation holes 3 in correspondence to the volume of the refrigerator and its freezing capacity. In this case, a discharge ventilator and an intake ventilator are mounted independently. In this embodiment, cylindrical or rectangular extension portions 6 and 7 of first and second frames 4 and 5 are slidably fitted together. Thus, it is possible to obtain easy dimensional adjustment according to the thickness of the wall panel 2. It is thus possible to ensure a wide adjustment range.

As has been described in the foregoing, separate ventilators are used for a function of reducing the air pressure in the refrigerator by exhausting air therefrom at the time when the refrigerator air pressure is increased, and a function of increasing the refrigerator air pressure by introducing air into the refrigerator at the time when the refrigerator air pressure is reduced. These two different ventilators can be readily assembled using like or same components in different arrangements. This means that it is necessary to prepare only a single kind of simplified part. It is thus possible to reduce the manufacturing cost of the ventilator.

What is claimed is:

1. A ventilator for a refrigerator, comprising a first frame having inner and outer sides and an extension portion inserted into a ventilation hole provided in a wall panel of a refrigerator;

a second frame having an extension portion inserted into said ventilation hole from the outside of the refrigerator so as to at least partly enclose the extension portion of said first frame; and a mounting base (8) removably mounted in said first frame at one side thereof, said mounting base being provided with a valve body (9) removably attached to the mounting base (8) and a valve plate (10) pivotably mounted on the valve body; said first and second frames being coupled together with their respective extension portions fitted together, the orientation of the mounting of said mounting base in said first frame being varied for using the ventilator either for discharge or for intake of ventilation air for the refrigerator.

2. A ventilator as defined by claim 1, wherein said mounting base (8) is mounted on said first frame (4) at a location adjacent the inner end of the first frame for opening the valve plate (10) to the outside of the refrigerator.

3. A ventilator as defined by claim 1, wherein said mounting base (8) is mounted on said first frame (4) at a location adjacent the outer end of the first frame for opening the valve plate (10) to the inside of the refrigerator.

4. A ventilator as defined in claim 1, wherein a cover (14) is attached to said second frame.

5. A ventilator as defined in claim 1, wherein a heater (16) is attached to an extended portion of said first frame.

6. A ventilator for a refrigerator, comprising:

(a) a first frame having inner and outer sides and a rectangular shaped extension portion inserted into a ventilation hole provided in a wall panel of a refrigerator;

(b) a second frame having an outer side and a rectangular shaped extension portion inserted into the ventilation hole from outside the refrigerator so as to at least partly enclose the extension portion of said first frame;

(c) a mounting base plate (8) removably mounted in said first frame on the outer side thereof, said mounting base plate being provided with a valve body (9) removably attached to the mounting plate and having a valve plate (10) pivotably mounted on the valve body at a location adjacent the inner side of said first frame for opening to outside the refrigerator, said first and second frames being coupled together with their respective rectangular shaped extension portions fitted together, the orientation for mounting of the mounting base plate in said first frame being arranged for using the ventilator for discharge of ventilation air; and (d) a cover attached to the outer side of said second frame.

7. A ventilator for a refrigerator, comprising:

(a) a first frame having inner and outer sides and a rectangular shaped extension portion inserted into a ventilation hole provided in a wall panel of a refrigerator;

(b) a second frame having an outer side and a rectangular shaped extension portion inserted into the ventilation hole from outside the refrigerator, so as to at least partly enclose the extension portion of said first frame;

(c) a mounting base plate (8) removably mounted in said first frame on the inner side thereof, said mounting base plate being provided with a valve body (9) removably attached to the mounting plate and having a valve plate (10) pivotably mounted on the valve body at a location adjacent the outer side of said first frame for opening to the inside of the refrigerator, said first and second frames being coupled together with their respective rectangular shaped extension portions fitted together so that the orientation for mounting of the mounting base plate in said first frame is arranged for intake of ventilation air; and (d) a cover attached to the outer side of said second frame.

* * * * *